US005947307A

United States Patent [19]

Battaglia et al.

[11] Patent Number: 5,947,307

[45] Date of Patent: Sep. 7, 1999

[54] SELF STANDING MERCHANDISER

[75] Inventors: Joseph M. Battaglia, Douglasville; Rafael T. Bustos, Atlanta, both of Ga.

[73] Assignee: L&P Property Management Company, South Gate, Calif.

[21] Appl. No.: 08/980,498

[22] Filed: Dec. 1, 1997

Related U.S. Application Data

[63] Continuation-in-part of application No. 29/078,605, Oct. 29, 1997, Pat. No. Des. 400,738.

[51] Int. Cl.[6] ..... A47F 5/00

[52] U.S. Cl. ..... 211/187; 211/182; 211/189; 108/108

[58] Field of Search ..... 211/186, 187, 211/182, 189, 133.1; 108/107, 108, 180, 186, 187

[56] References Cited

U.S. PATENT DOCUMENTS

| | | | |
|---|---|---|---|
| D. 189,510 | 12/1960 | Tissot . | |
| D. 299,392 | 1/1989 | Hunt . | |
| D. 315,459 | 3/1991 | Young, III et al. . | |
| D. 321,615 | 11/1991 | Lavine et al. . | |
| D. 326,970 | 6/1992 | Allen . | |
| D. 334,859 | 4/1993 | Homann . | |
| D. 336,803 | 6/1993 | Stoddard et al. . | |
| D. 363,623 | 10/1995 | Rushing . | |
| D. 367,195 | 2/1996 | Whittington . | |
| D. 373,913 | 9/1996 | Wyatt et al. . | |
| D. 400,738 | 11/1998 | Bustos et al. | D6/476 |
| 462,509 | 11/1891 | Roberts . | |
| 679,003 | 7/1901 | McRay . | |
| 2,088,149 | 7/1937 | Boston . | |
| 2,091,355 | 8/1937 | Ekedahl et al. . | |
| 2,555,178 | 5/1951 | Young . | |
| 2,873,033 | 2/1959 | Mapstone . | |
| 2,925,921 | 2/1960 | De Pew et al. | 211/189 |
| 2,972,418 | 2/1961 | Burns et al. . | |
| 2,991,888 | 7/1961 | Shivek . | |
| 3,085,694 | 4/1963 | Jones . | |
| 3,121,496 | 2/1964 | Brunette . | |
| 3,178,198 | 4/1965 | Hamilton . | |
| 3,556,306 | 1/1971 | Shell | 211/90.02 |
| 3,604,669 | 9/1971 | Asher | 211/90.01 X |
| 4,299,327 | 11/1981 | Thauer . | |
| 4,312,086 | 1/1982 | Bianco | 108/108 X |
| 4,415,150 | 11/1983 | Iezza | 211/182 X |
| 4,633,788 | 1/1987 | Robertson | 211/189 X |
| 4,697,712 | 10/1987 | Valiulis . | |
| 4,974,734 | 12/1990 | Merl . | |
| 4,976,360 | 12/1990 | Zucker et al. . | |
| 5,065,873 | 11/1991 | Tseng | 211/187 |
| 5,201,191 | 4/1993 | Bustos | 211/187 X |
| 5,347,922 | 9/1994 | Metcalf | 211/187 X |
| 5,588,541 | 12/1996 | Goetz . | |

FOREIGN PATENT DOCUMENTS

| | | |
|---|---|---|
| 541793 | 10/1955 | Belgium . |
| 74107 | 4/1952 | Denmark . |
| 624830 | 7/1927 | France . |
| 1234829 | 10/1960 | France . |
| 455893 | 2/1928 | Germany . |
| 863593 | 11/1952 | Germany . |
| 96848 | 2/1961 | Netherlands . |
| 309697 | 4/1929 | United Kingdom . |

*Primary Examiner*—Robert W. Gibson, Jr.
*Attorney, Agent, or Firm*—Wood, Herron & Evans, L.L.P.

[57] ABSTRACT

A self standing merchandiser adapted to straddle a pallet loaded with product or an end display of product. The merchandiser comprises a continuous frame made of multiple pieces having an inverted U-shaped front portion and an inverted U-shaped rear portion connected by two stabilizer portions adapted to engage the supporting surface of the continuous frame. A plurality of parallel shelves extend between the front and rear portions of the merchandiser on the exterior of the frame and provide additional shelving.

31 Claims, 6 Drawing Sheets

SELF STANDING MERCHANDISER

This patent application is a continuation-in-part patent application of U.S. design patent application Ser. No. 29/078,605 filed Oct. 29, 1997, now U.S. Design Pat. No. D400,738, which is hereby fully incorporated by reference.

FIELD OF THE INVENTION

This invention relates to a self standing merchandiser and, more particularly, to a self standing merchandiser which is adapted to straddle an end display of product.

BACKGROUND OF THE INVENTION

In grocery stores, products are arranged in longitudinally extending rows of shelving with aisles between adjacent rows in which the customers walk while viewing displayed product located on the shelves. Often products on sale or product which the store particularly wants to sell are placed on an end display at the end of a row of product shelving. Such an end display may be a plurality of cans of product loaded on top of a pallet or alternatively may be an end display rack with a plurality of horizontal shelves on which products are displayed. However, often on such end displays, there is not enough shelving space for all the product desired to be displayed.

If additional product is to be displayed, additional shelving must be provided. Therefore,, there is a need for a display rack or merchandiser which may be adapted to fit around an end display of product which provides additional shelving. It is desirable if such additional shelving does not interfere with the end display and is complimentary with the end display in appearance.

U.S. Pat. No. 3,085,649 discloses a merchandise display rack which has two sub-assemblies or end frame units adapted to fit on the ends of a central display rack. Each of these end frame units must be fastened to the central portion of the merchandise display rack with bolts or other fasteners. Neither end frame unit is self supporting. The central portion of the display rack has a plurality of shelves extending longitudinally (from side to side). Both end frame units provide additional shelving running front to back and are specifically adapted to be used with only one particular configuration of display rack. In other words, the end frame units are not adapted to be used with different types of end display racks.

Two patents which do disclose self standing display racks are U.S. Pat. No. 679,033 and Design Pat. No. 189,510. However, the display racks which are the subject of these patents are not adapted to fit over an end display of product having horizontally extending shelving. Rather, these display racks are adapted to stand on their own and have a plurality of shelves extending front to back. In addition, the display rack of Design Pat. No. 189,510 has a plurality of horizontal shelves extending from side to side.

None of the above mentioned individual self supporting or self standing display racks are adapted to be specifically used with a conventional display rack having horizontal shelving or with a pallet loaded with product. In addition, none of the above mentioned self standing display racks is adapted to fit over and around a conventional display rack in order to provide additional shelving.

Therefore, it has been one objective of the present invention to provide a display rack or merchandiser which is self standing and provides additional shelving to an end display.

In addition, it has been a further objective of the present invention to provide a merchandiser which is adapted to provide shelving on both sides of an end display located at the end of a row of product.

It has been a further objective of the present invention to provide a self standing merchandiser capable of having at least one header for advertisement purposes secured to the top of the merchandiser.

SUMMARY OF THE INVENTION

The invention of the present application which accomplishes these objectives comprises a self standing merchandiser adapted to straddle a pallet loaded with product. The merchandiser comprises a continuous frame, multiple shelf support brackets removably secured to the continuous frame and a plurality of removable shelves extending between pairs of shelf support brackets. The continuous frame has an inverted U-shaped front portion, an inverted U-shaped rear portion and two stabilizer portions connected to the bottom of the front and rear portions of the continuous frame. The stabilizer portions are adapted to engage a supporting surface, such as a floor surface, such that the merchandiser may stand on its own on the supporting surface and does not depend at all upon the end display which the merchandiser is adapted to straddle.

The inverted U-shaped front portion comprises a pair of vertical front tubes connected by a front cross tube which has an inverted U shape. The inverted U-shaped rear portion comprises two vertical rear tubes connected to each other with a rear cross tube which also has an inverted U shape. The front and rear cross tubes are located at the top of the merchandiser and connect the upper portions of the front and rear vertical tubes.

Each stabilizer portion connects one of the front tubes to one of the rear tubes and is also generally U-shaped extending outwardly from the front and rear vertical tubes. Thus, the continuous frame is made of multiple pieces of hollow tubing fitted together to form a self standing unit.

The shelf support brackets; have a plurality of tabs extending outwardly therefrom adapted to engage individual slots in the vertical members of the front and rear portions of the continuous frame. The vertical tubes of the continuous frame have multiple slots therein enabling the height of the shelf support brackets to be adjusted in order to vary the height between adjacent shelves.

A plurality of removable shelves extend between the shelf support brackets and are supported by the shelf support brackets. Each of the removable shelves thus extends from front to back of the self standing merchandiser and is adapted to support a plurality of additional products other than those loaded on the pallet or end display straddled by the self standing merchandiser.

The merchandiser may further comprise an X brace assembly secured to the cross members of the continuous frame. A plurality of header panels may be secured to the ends of the individual members of the X brace assembly creating an attractive advertising display on top of the self standing merchandiser. The X brace assembly provides additional stability to the self standing merchandiser by fixing the distance between the front and rear cross tubes of the continuous frame of the self standing merchandiser.

Thus, the self standing merchandiser of the present invention provides additional shelving space on the exterior of an end display of product thus widening the display at the end of a row of product shelving and making the end display more attractive to customers.

DETAILED DESCRIPTION OF THE PREFERRED EMBODIMENT

Figure 1:
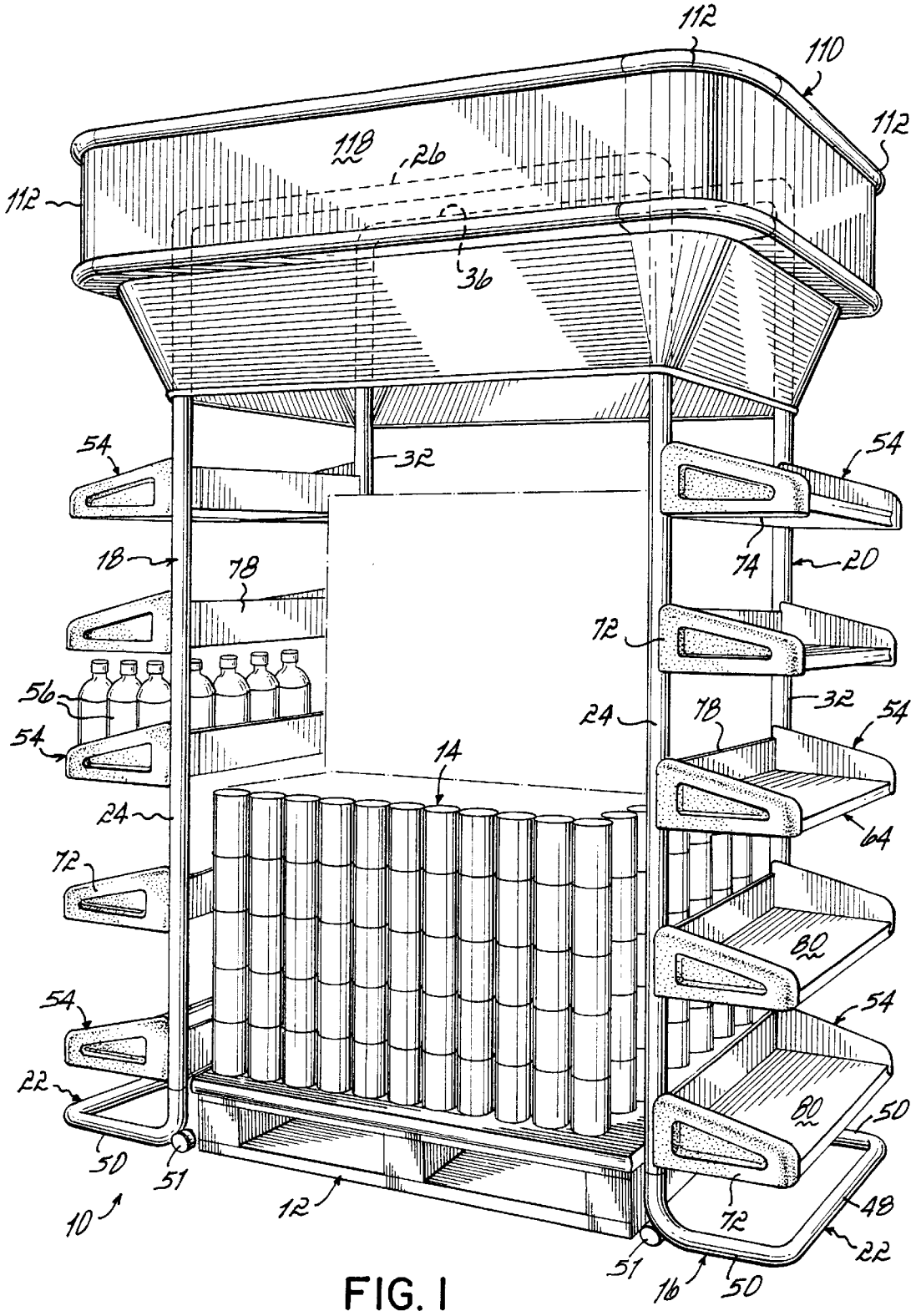
FIG. 1 is a perspective view of the self standing merchandiser of the present invention straddling a pallet loaded with product.

Referring to FIG. 1, the shelf standing merchandiser 10 of the present invention is illustrated straddling a pallet 12 loaded with product 14. The product 14 is stacked in a generally square or rectangular configuration and may or may not be placed on a pallet. In place of a pallet loaded with product may be a conventional rectangular display rack having side to side horizontal shelving (not shown).

Figure 1A:
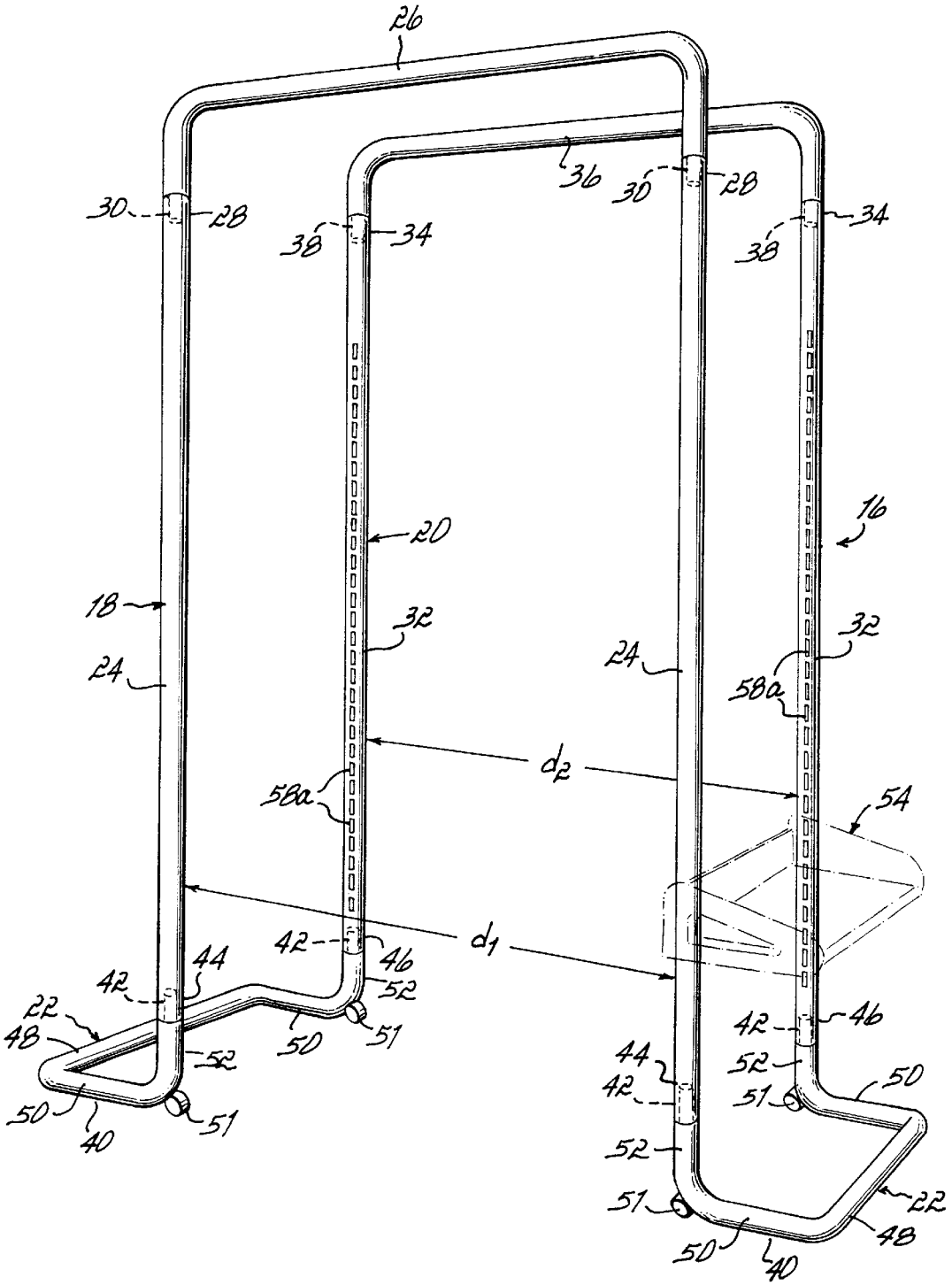
FIG. 1A is a perspective view of the continuous frame of the self standing merchandiser of FIG. 1.

The shelf standing merchandiser 10 itself comprises a continuous frame 16 best illustrated in FIG. 1A made up of multiple pieces of hollow tubing. Although the tubing is typically hollow, solid pieces rather than hollow pieces are also within the purview of the present invention. Similarly, the continuous frame 16 is typically made of metal but may be constructed of other materials as well, such as plastic, aluminum or metal.

Referring to FIG. 1 A, continuous frame 16 has an inverted U-shaped front portion 18, an inverted U-shaped rear portion 20 and two stabilizer portions 22. The stabilizer portions 22 are adapted to engage a supporting surface such as a floor and enables the merchandiser 10 to stand on its own on the supporting surface.

The front portion 18 of the continuous frame 16 comprises two vertical front tubes 24 which are parallel to each other and spaced apart a distance ($d_1$) which is slightly larger than the width of the pallet loaded with product or the end display rack found in a grocery store. The two vertical front tubes 24 are connected by a front cross tube 26 which is generally in the shape of an inverted U. This front cross tube 26 may take on the configuration illustrated in FIG. 1A or the configuration shown in FIG. 7 or other types of configurations not illustrated. Regardless of the configuration, the front cross tube 26 connects the upper portions 28 of the two vertical front tubes 24. The front cross tube 26 has two projections 30 at the ends of the front cross tube 26 which are slightly smaller in diameter than the inner diameter of the hollow vertical front tubes 24 and therefore fit down inside the hollow interior of the upper portions 28 of the vertical front tubes 24 thereby connecting the two vertical front tubes 24 together.

Like the front portion 18 of the continuous frame 16, the rear portion 20 of the continuous frame 16 comprises two vertical members referred to as rear tubes 32 which, like the vertical front tubes 24, are parallel and spaced apart from each other a distance $d_2$ which may be the same distance as the front tubes are spaced apart from each other. Each vertical rear tube 32 has an upper portion 34 which is generally hollow. The upper portions 34 of the rear tubes 32 are connected by a rear cross tube 36 which is identically configured to the front cross tube 26 and has a generally inverted U shape. The ends of the rear cross tube 36 have projections 38 which fit inside the hollow interior of the upper portions 34 of the vertical rear tubes 32.

Each of the vertical front tubes 24 is connected to one of the vertical rear tubes 32 with a generally U-shaped stabilizer tube 40. Therefore, the stabilizer portion 22 referred to earlier comprises solely a stabilizer tube 40 located on each side of the continuous frame 16. Each stabilizer tube 40 has projections 42 extending upwardly therefrom which engage the lower portions 44, 46 of the vertical front and rear tubes 24, 32 respectively. Each stabilizer tube 40 has an outward portion 48, two parallel middle portions 50 which are coplanar with the outer portion 48 and two end portions 52 which extend upwardly from the middle portions 50, each end portion 50 terminating in a projection 42.

A pair of rods 51 may be secured to each stabilizer tube 40 in order to further stabilize the stabilizer portion 22 of the continuous frame 16 as best seen in FIG. 1A. A rod 51 is located directly below each end portion 52 of both stabilizer tubes and toward the inside ends of the middle portions 50 of the stabilizer tubes 40. These rods 51 help to prevent the continuous frame 16 from falling over during assembly of the continuous frame 16. The rods may be welded or otherwise secured to the stabilizer tubes 40 and are typically 1½" in diameter and 1" in length. However, they may be made of any size. In addition, the rods 51 may be solid or hollow.

As one can see from FIGS. 1 and 1A, the individual pieces of the continuous frame 16 are fitted together so as to make an endless continuous frame 16 comprising a generally U-shaped front portion 18 and a generally U-shaped back or rear portion 20, the front and back portions 18, 20 being parallel to each other and raised above the floor or supporting surface. The front and rear portions 18, 20 of the continuous frame 16 are connected by two stabilizer portions 22 which are adapted to engage the supporting surface or floor and function to provide a base supporting the weight the continuous frame holds. As seen in FIGS. 1 and 1A, a plurality of shelves 54 are removably secured to the vertical front and rear tubular members 24, 32 of the continuous frame 16 and support additional products 56 on the sides of the end display of product 14. Each shelf 54 extends from one of the vertical front tubes 24 to one of the vertical rear tubes 32 and is supported by the front and rear tubes 24, 32 respectively. Although a specific configuration of shelf is illustrated in FIGS. 2–5 in detail, alternative shelves may be utilized in accordance with the present invention without departing from the concept of the present invention.

Figure 2:
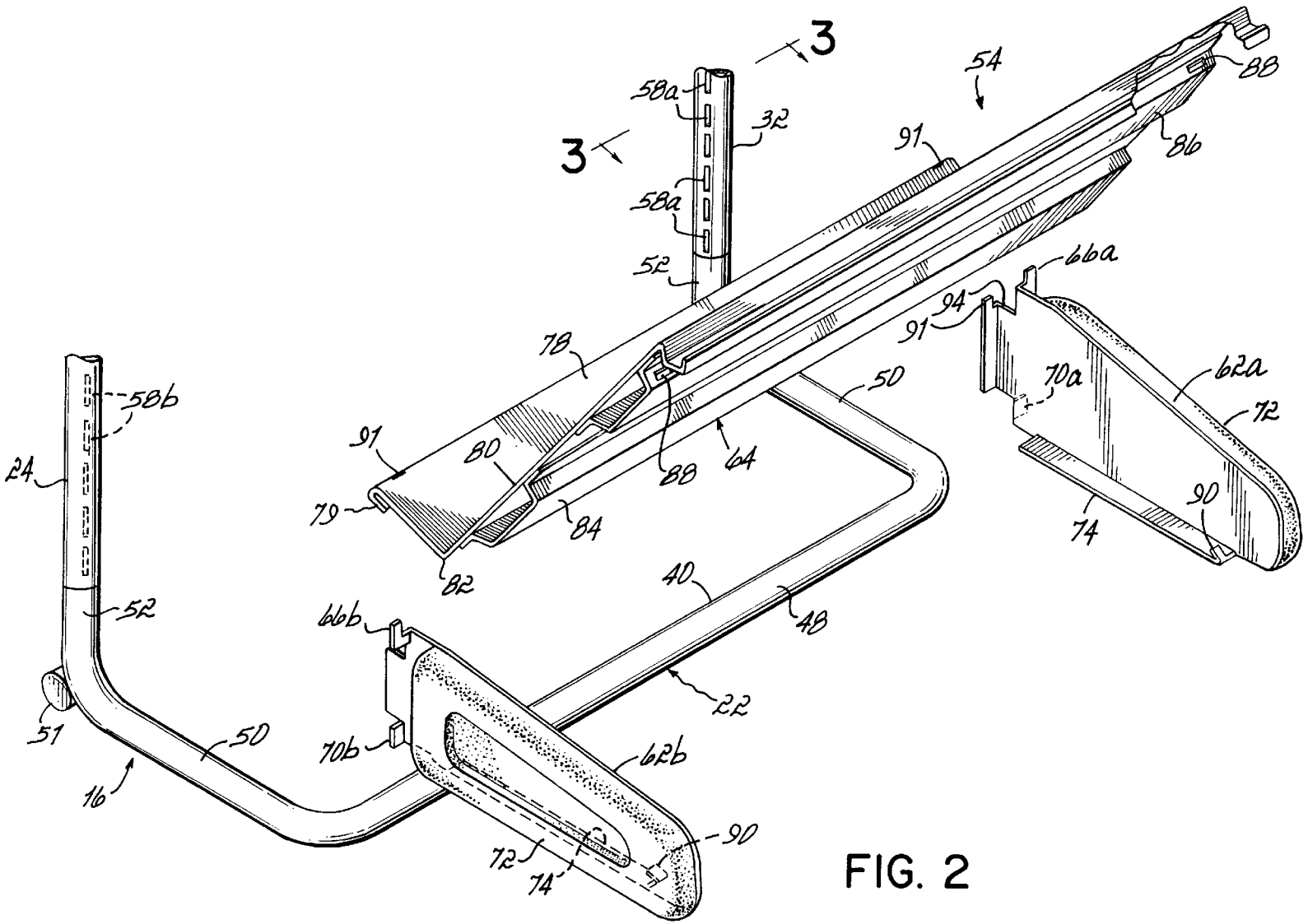
FIG. 2 is an exploded perspective view of a shelf adapted to be secured to the continuous frame of the self standing merchandiser of FIG. 1.
Figure 3:
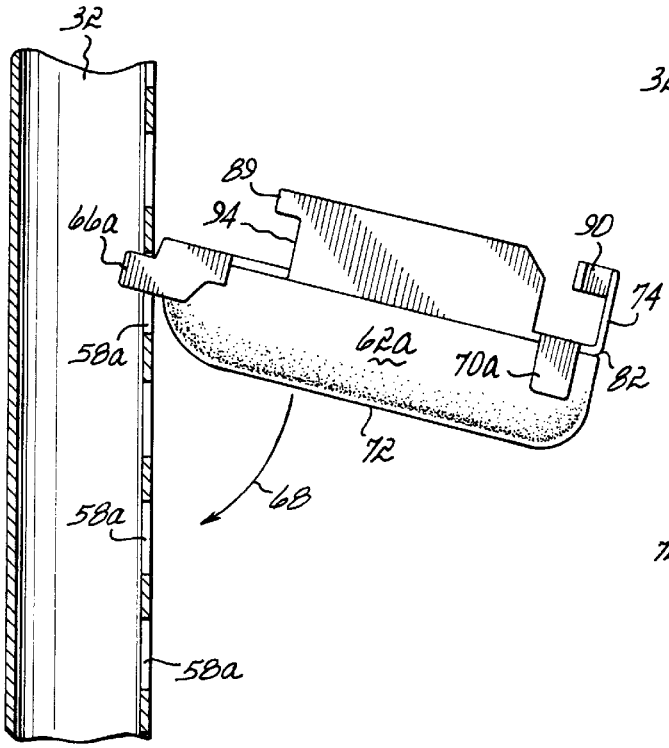
FIG. 3 is a cross-sectional view taken during the shelf assembly process generally along the lines 3—3 of FIG. 2.
Figure 4:
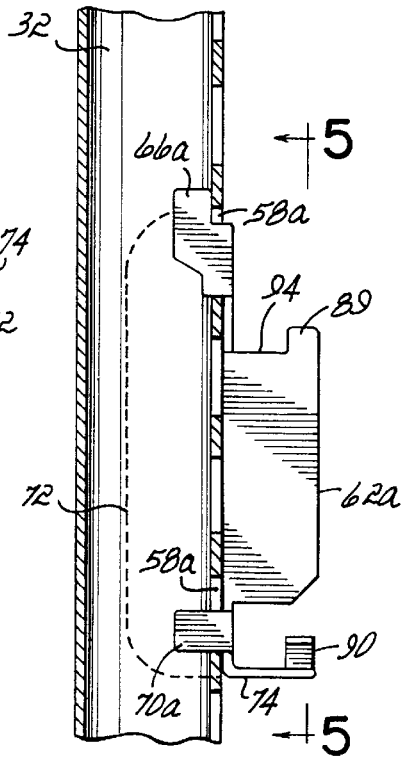
FIG. 4 is a cross-sectional view similar to FIG. 3 depicting the shelf support bracket in an assembled configuration.

The shelves 54 secure to the front and rear tubes 24, 32 of the continuous frame in a manner illustrated in FIGS. 2–5. Each of the rear and front tubes 32, 24 have a plurality of spaced slots 58*a, b* on the inside portions thereof which are adapted to receive tabs 66*a,* 70*a* and 66*b,* 70*b* of shelf support brackets 62*a, b* respectively. Referring to FIG. 2, rear tube 32 has a plurality of slots 58*a* therein which receive tabs 66*a,* 70*a* of shelf support bracket 62*a*. Likewise, front tube 24 has a plurality of slots 58*b* on the inside surface thereof which receive tabs 66*b,* 70*b* of shelf supporting bracket 62*b*. A shelf support 64 extends between the shelf support brackets 62*a* and 62*b* and is the supporting surface on which the additional products 56 rest (FIG. 1). The manner in which the shelf support brackets 62*b,* a are secured to the front and rear tubes 24, 32 is best illustrated in FIGS. 3 and 4. Referring to FIG. 3, upper tab 66*a* of shelf support bracket 62*a* is inserted into one of the slots 58*a* and the shelf supporting bracket 62*a* moved in the direction of arrow 68 downwardly and inwardly until a lower tab 70*a* engages a slot 58*a* below the slot which received the upper tab 66*a*. Once a shelf support bracket 62*a* and 62*b* is secured to both the front and rear tubes 24, 32 of the continuous frame 16, the shelf support member 64 may be secured to the two shelf support brackets 62*a, b* in a manner illustrated best in FIG. 5. Each shelf support bracket 62*a, b* has an outwardly bowed portion 72 and a generally horizontal planar lower portion 74 (see FIG. 2).

Figure 5:
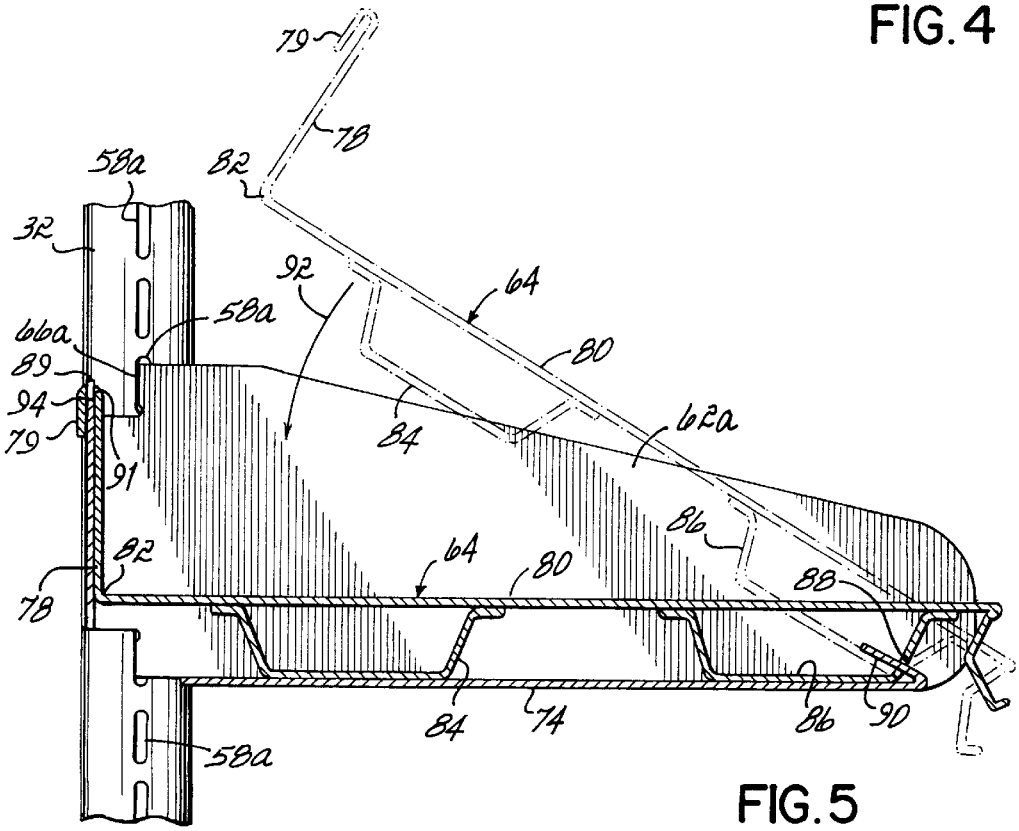
FIG. 5 is a cross-sectional view taken along the lines 5—5 of FIG. 4 after attachment of the shelf to the shelf support brackets.

Referring now to FIG. 5, the shelf support 64 is generally L-shaped with a vertical portion 78 and a horizontal portion 80 being generally perpendicular to each other and joined at a back corner 82. A generally U-shaped back rib 84 and a generally U-shaped front rib 86 are secured to the horizontal portion 80 of the shelf support 64. As best illustrated in FIGS. 2 and 5, two opposed holes 88 in the front rib 86 are adapted to receive tabs 90 projecting upwardly and forwardly from the lower portion 74 of the shelf support brackets 62*a, b*. When a shelf support 64 is to be secured to two opposed shelf support brackets 62*a, b,* the front portion of the shelf support 64 is lowered downwardly as illustrated in FIG. 5 until the tabs 90 of the shelf support brackets 62*a, b* engage the holes 88 of the front rib 86 of the shelf support 64. Once the tabs 90 are in the holes 88, the horizontal portion 80 of the shelf support 64 is lowered in the direction of arrow 92 until the ribs 84, 86 rest on the lower portion 74 of the shelf support brackets 62*a, b* and a hook 79 formed at the top of the vertical portion 78 of the shelf support 64 engages an upper edge 94 of the shelf support brackets 62*a, b*. An upper tab 89 located on each shelf support bracket 62*a, b* extends from the upper edge 94 of each shelf support bracket 62*a, b* and cooperates with a slot 91 formed in the hook 79 of the shelf support 64 so as to properly align the shelf support 64 with the shelf support brackets 62*a, b*. Although one specific type of shelf having two shelf support brackets 62 and a middle shelf support 64 extending between the shelf support brackets 62 has been described in detail, other one piece shelves or multiple piece shelves may be utilized in accordance with the present invention as long as they extend between the vertical front and rear tubes or members of the continuous frame.

Figure 6:
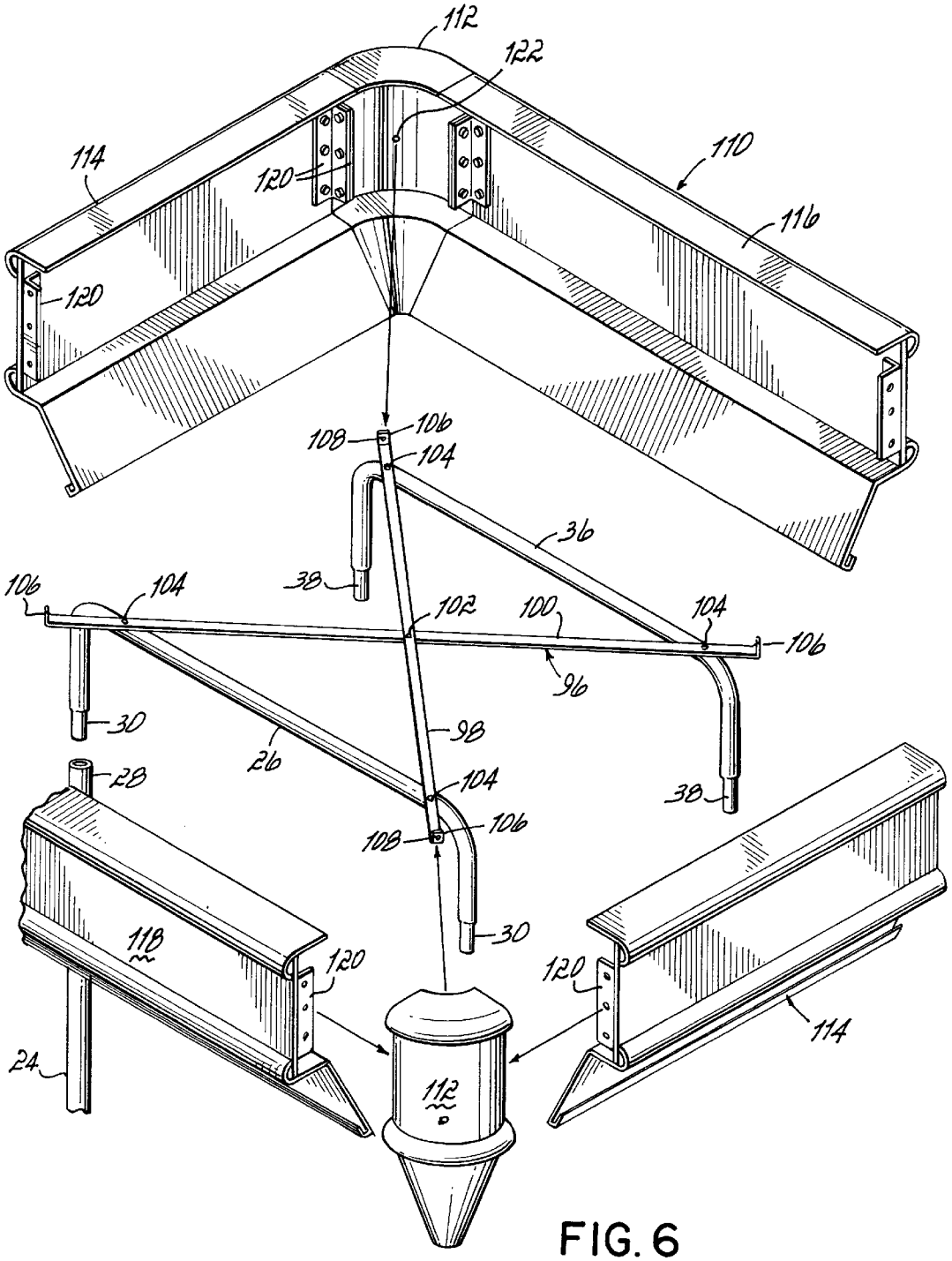
FIG. 6 is an exploded perspective view of one embodiment of the top portion of the shelf standing merchandiser of the present invention having an X brace assembly secured to the continuous frame and having a header secured to the X brace assembly.

Referring now to FIG. 6, an X brace assembly 96 comprising a first member 98 and a second member 100 form an X-type configuration and intersect at a point 102. The ends of the first and second members 98, 100 are secured to the front and rear cross tubes 26, 36 of the continuous frame 16 with fasteners 104. Thus secured, the X brace assembly 98 prevents the front and rear cross bars 26, 36 of the continuous frame 16 from moving relative to each other and provides additional stability to the continuous frame 16 as a whole.

In addition, the first and second members 98, 100 of the X brace assembly 96 have upwardly turned ends 106 each of which have a hole 108 therein. These upwardly turned ends 106 are specifically configured so as to enable a fastener (not shown) to secure a header 110 to the individual members 98, 100 of the X brace assembly. The header 110 comprises four corner pieces 112 which are fastened to two side pieces 114, a rear piece 116 and a front piece 118. The individual pieces are secured together with brackets 120 but any other means of securing the individual pieces of the header together could be used in accordance with the present invention. A hole 122 in each of the corner pieces 112 enables a fastener (not shown) to secure the corner piece 112 to the ends 106 of the X brace assembly 96. Once the corner pieces 112 are secured to the ends 106 of the members 98, 100 of the X brace assembly, the side pieces or members 114 of the header and the front and rear pieces 118, 116 of the header 110 may be secured to the corner pieces 102 with the brackets 120 thus creating a generally rectangular header which is typically used for advertising purposes.

Figure 7:
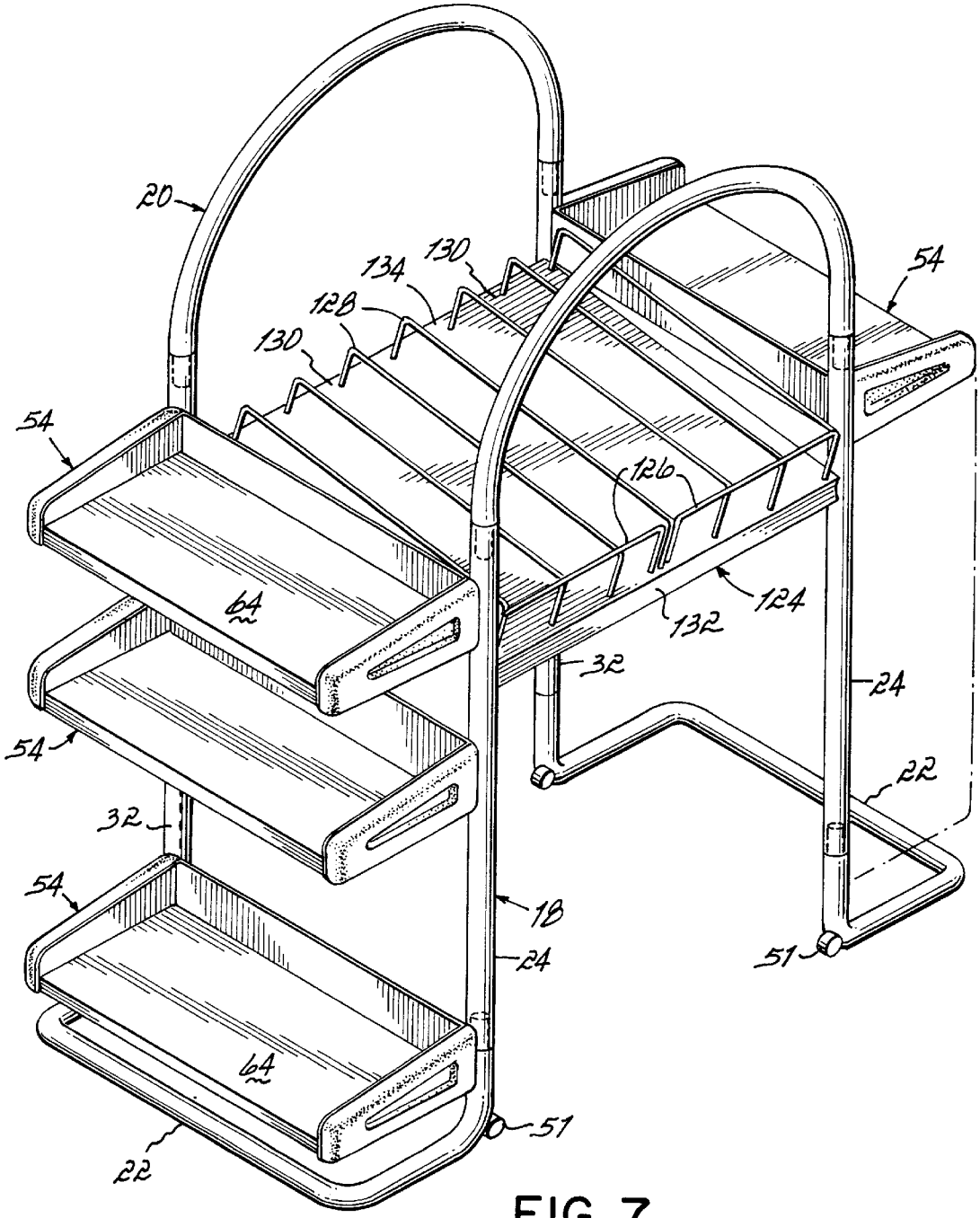
FIG. 7 is a perspective view of an alternative embodiment of the self standing merchandiser of the present invention.

An alternative embodiment of the present invention is illustrated in FIG. 7. In this embodiment, the continuous frame 16 is identical to the continuous frame described hereinabove and the shelves are identical as well. However, this embodiment is not intended to straddle an end display of product but rather is adapted to stand on its own. This embodiment has middle shelves 124 extending between the front and rear portions 18, 20 of the continuous frame. These middle shelves 124 may be secured in any manner to the vertical front and rear tubes 24, 32 of the continuous frame 16 including the same manner in which the side shelves 54 are secured to the front and rear tubes of the continuous frame. These middle shelves 124 may have bumper stops 126 at the front thereof to prevent product from failing off an inclined shelf, for example, (see FIG. 7) and may have a plurality of internal dividers 128 which divide the shelf 124 into a plurality of tracks 130. Although one specific type of middle shelf 124 is shown in FIG. 7 having a front edge 132 located below a rear edge 134 of the middle shelf such that the middle shelf is declined, alternative shelves such as horizontal middle shelves may be used in accordance with the present invention. In addition, the X brace assembly 96, with or without a header 110 secured to the X brace assembly, may be utilized with this alternative embodiment including the middle shelves.

While we have described two embodiments of the present invention, we do not intend to be limited except by the scope of the following claims.

What is claimed is:

1. A self-standing merchandiser adapted to straddle an end display of product, said merchandiser comprising:

a continuous frame made of multiple pieces, said frame comprising an inverted U-shaped front portion and an inverted U-shaped rear portion, said front and rear portions being connected by two stabilizer tubes adapted to engage a supporting surface such that said merchandiser may stand on its own on the supporting surface, multiple shelves removably secured to said front and rear portions of said continuous frame adapted to support additional products.

2. The merchandiser of claim 1 further comprising an X-brace assembly secured to said continuous frame.

3. The merchandiser of claim 2 further comprising at least one header secured to said X-brace assembly.

4. The merchandiser of claim 1 wherein said continuous frame is made of metal.

5. A self-supporting merchandiser adapted to straddle an end display of product, said merchandiser comprising:

a continuous hollow tubular frame comprising two vertical front tubes and two vertical rear tubes, said vertical front tubes being connected to each other with a front cross tube in the shape of an inverted U and said vertical rear tubes being connected to each other with a rear cross tube in the shape of an inverted U, each of said vertical front tubes being connected to one of said vertical rear tubes with a generally U-shaped stabilizer tube such that said stabilizer tubes provide a base for supporting said frame, multiple shelf support brackets removably secured to said vertical front and rear tubes, multiple removable shelves extending between pairs of end brackets capable of supporting additional product.

6. The self-supporting merchandiser of claim 5 further comprising an X-brace assembly secured to said cross tubes of said continuous frame.

7. The self-supporting merchandiser of claim 6 further comprising a header secured to said X-brace assembly.

8. The self-supporting merchandiser of claim 5 wherein said continuous frame is made of metal.

9. A self-supporting merchandiser adapted to straddle an end display of product, said merchandiser comprising:

a continuous hollow tubular frame comprising two vertical front tubes and two vertical rear tubes, said vertical front tubes being connected to each other with an inverted U-shaped front cross tube and said vertical rear tubes being connected to each other with an inverted U-shaped rear cross tube, a lower portion of each of said vertical front tubes being connected to a lower portion of a corresponding vertical rear tube with a generally U-shaped stabilizer tube such that said stabilizer tubes provide a base for supporting said frame, multiple removable shelves extending between said vertical front tubes and said vertical rear tubes, said removable shelves being capable of supporting additional product.

10. The self-supporting merchandiser of claim 9 wherein said removable shelves are generally above said stabilizer tubes.

11. The self-supporting merchandiser of claim 9 wherein said removable shelves are on both sides of said end display of product.

12. A self-supporting merchandiser adapted to straddle a pallet loaded with product, said merchandiser comprising:

a plurality of pieces of hollow tubing connected together to form a continuous frame, said pieces including a pair of vertical front frame tubes, a pair of vertical rear frame tubes, an inverted U-shaped front cross tube, an inverted U-shaped rear cross tube, and a pair of generally U-shaped stabilizer tubes, said stabilizer tubes being adapted to rest upon a supporting surface and support a loaded merchandiser such that said merchandiser may stand on its own on the supporting surface, multiple shelves removably secured to said vertical front and rear tubes of the continuous frame.

13. The self-supporting merchandiser of claim 12 further comprising an X-brace assembly secured to the cross tubes of said continuous frame.

14. The self-supporting merchandiser of claim 13 further comprising a plurality of header panels secured to the X-brace assembly.

15. The self-supporting merchandiser of claim 13 wherein said front cross tube connects upper portions of said vertical front frame tubes and said rear cross tube connects; upper portions of said vertical rear frame tubes.

16. A self-supporting merchandiser adapted to straddle a pallet loaded with product, said merchandiser comprising:

a plurality of pieces of hollow tubing connected together to form a continuous frame, said pieces including a pair of vertical front frame tubes connected by an inverted U-shaped front cross tube, a pair of vertical rear frame tubes connected by an inverted U-shaped rear cross tube, and a pair of generally U-shaped stabilizer tubes, said stabilizer tubes being adapted to rest upon a supporting surface and support a loaded merchandiser such that said merchandiser may stand on its own on the supporting surface, said stabilizer tubes extending outwardly from said end display of product, multiple removable shelves extending between said vertical front tubes and said vertical rear tubes of said continuous frame capable of supporting additional product.

17. The self-supporting merchandiser of claim 16 further comprising an X-brace assembly secured to an upper portion of said continuous frame for additional stability.

18. The self-supporting merchandiser of claim 17 further comprising a plurality of header panels secured to the X-brace assembly.

19. The self-supporting merchandiser of claim 16 further comprising a plurality of shelf support brackets removably secured to said continuous frame at varying heights, said removable shelves being removably secured to said shelf support brackets.

20. A self-supporting merchandiser adapted to straddle an end display of product, said merchandiser comprising:

a continuous frame of hollow tubing, said frame comprising an inverted U-shaped front portion and an inverted U-shaped rear portion, said front and rear portions being connected by two stabilizer portions adapted to engage a supporting surface, multiple shelf support brackets removably secured to said front and rear portions of said continuous frame, multiple removable shelves extending between pairs of shelf support brackets capable of supporting additional product.

21. The merchandiser of claim 20 further comprising an X-brace assembly secured to said continuous frame.

22. The merchandiser of claim 21 further comprising at least one header secured to said X-brace assembly.

23. The merchandiser of claim 22 further comprising said X-brace assembly comprises two crossing members each extending between said front and rear portions of said continuous frame.

24. The merchandiser of claim 20 wherein each of said stabilizer portions of said continuous frame is generally U-shaped.

25. The merchandiser of claim 24 wherein said stabilizer portions of sad continuous frame extend outwardly from said end display of product.

26. A self-standing merchandiser comprising:

a continuous frame made of multiple pieces, said frame comprising an inverted U-shaped front portion and an inverted U-shaped rear portion, said front and rear portions being connected by two stabilizer tubes adapted to engage a supporting surface such that said merchandiser may stand on its own on the supporting surface, multiple side shelves removably secured to said front and rear portions of said continuous frame adapted to support additional products; and a plurality of middle shelves, each middle shelf being removably secured to said front and rear portions of said continuous frame.

27. The self standing merchandiser of claim 26 wherein said middle shelves are declined with the front edge of each middle shelf being below the back edge of the middle shelf.

28. A self-supporting merchandiser comprising:

a continuous hollow tubular frame comprising two vertical front tubes and two vertical rear tubes, said vertical front tubes being connected to each other with a front cross tube in the shape of an inverted U and said vertical rear tubes being connected to each other with a rear cross tube in the shape of an inverted U, each of said vertical front tubes being connected to one of said vertical rear tubes with a generally U-shaped stabilizer tube such that said stabilizer tubes provide a base for supporting said frame, a plurality of removable side shelves, each side shelf extending between one of said vertical front tubes and one of said vertical rear tubes; and at least one middle shelf removably secured to each of said vertical front tubes and each of said vertical rear tubes.

29. The merchandiser of claim 28 further comprising an X-brace assembly secured to said continuous frame.

30. The merchandiser of claim 29 further comprising at least one header secured to said X-brace assembly.

31. The merchandiser of claim 28 wherein said continuous frame is made of metal.

* * * * *

UNITED STATES PATENT AND TRADEMARK OFFICE

CERTIFICATE OF CORRECTION

PATENT NO. : 5,947,307

DATED : September 7, 1999

INVENTOR(S) : Battaglia et al.

It is certified that error appears in the above-identified patent and that said Letters Patent is hereby corrected as shown below:

Col. 1, line 4, after "October 29, 1997" insert --entitled Side Saddle Merchandiser--.

Col. 2, line 36, delete the ";" after "brackets".

Col. 3, line 15, "shelf" should be --self--.

Col. 3, line 24, "shelf" should be --self--.

Col. 3, line 31, "shelf" should be --self--.

Col. 6, line 7, "102" should be --112--.

Col. 7, lines 37-38, "a pallet loaded with" should be --an end display of--.

Col. 7, line 58, delete the ";" after "connects".

Col. 7, lines 60-61, "a pallet load with" should be --an end display of--.

Col. 8, line 21, "self-supporting" should be --self-standing--.

UNITED STATES PATENT AND TRADEMARK OFFICE

CERTIFICATE OF CORRECTION

PATENT NO. : 5,947,307
DATED : September 7,1999
INVENTOR(S) : Battaglia et al.

It is certified that error appears in the above-identified patent and that said Letters Patent is hereby corrected as shown below:

Col. 8, line 27, after "surface" insert --such that said merchandiser may stand on its own on the supporting surface--.

Col. 8, line 37, "further comprising" should be --wherein--.

Col. 8, line 46, "sad" should be --said--.

Signed and Sealed this

Sixth Day of June, 2000

*Attest:*

*Attesting Officer*

Q. TODD DICKINSON

*Director of Patents and Trademarks*